US009558693B2

(12) United States Patent
An et al.

(10) Patent No.: US 9,558,693 B2
(45) Date of Patent: Jan. 31, 2017

(54) DISPLAY DEVICES AND ELECTRONIC DEVICES HAVING THE SAME

(71) Applicant: SAMSUNG DISPLAY CO., LTD., Yongin, Gyeonggi-Do (KR)

(72) Inventors: Bo-Young An, Hwaseong-si (KR); Sung-Chun Park, Suwon-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 78 days.

(21) Appl. No.: 14/702,918

(22) Filed: May 4, 2015

(65) Prior Publication Data

US 2016/0117979 A1 Apr. 28, 2016

(30) Foreign Application Priority Data

Oct. 23, 2014 (KR) ..... 10-2014-0143981

(51) Int. Cl.
*G09G 3/3208* (2016.01)
*G09G 3/32* (2016.01)

(52) U.S. Cl.
CPC ..... *G09G 3/3208* (2013.01); *G09G 2310/08* (2013.01); *G09G 2330/022* (2013.01); *G09G 2330/028* (2013.01)

(58) Field of Classification Search
CPC ..... G09G 3/3208; G09G 3/3696; G09G 2330/028; G09G 2330/00–2330/022;G09G 2310/08; G09G 2310/0243
See application file for complete search history.

(56) References Cited

U.S. PATENT DOCUMENTS

2008/0094386 A1* 4/2008 Park ..... G09G 3/3696 345/212
2013/0235016 A1* 9/2013 Seo ..... G09G 3/3208 345/212
2014/0160178 A1 6/2014 Hong et al.

FOREIGN PATENT DOCUMENTS

KR 10-2013-0081451 A 7/2013
KR 10-2014-0010798 A 1/2014
KR 10-2014-0020483 A 2/2014

* cited by examiner

*Primary Examiner* — Liliana Cerullo
(74) *Attorney, Agent, or Firm* — Lee & Morse, P.C.

(57) ABSTRACT

A display device includes a display panel driver and a DC-DC converter. The display panel driver divides one frame into a plurality of periods and outputs a control signal to generate an analog supply voltage, a first power voltage, and a second power voltage for driving pixels. The DC-DC converter receives the control signal from the display panel driver through a single wire. The DC-DC converter includes an analog supply voltage generator, a first power voltage generator, and a second power voltage generator. The analog supply voltage generator generates the analog supply voltage during a first pulse period. The first power voltage generator generates the first power voltage during a second pulse period. The second power voltage generator generates the second power voltage during the third pulse period.

20 Claims, 6 Drawing Sheets

DISPLAY DEVICES AND ELECTRONIC DEVICES HAVING THE SAME

CROSS-REFERENCE TO RELATED APPLICATION

Korean Patent Application No. 10-2014-0143981, filed on Oct. 23, 2014, and entitled, "Display Devices And Electronic Devices Having The Same," is incorporated by reference herein in its entirety.

BACKGROUND

1. Field

One or more embodiments described herein relate to a display device and an electronic device having a display device.

2. Description of the Related Art

A variety of flat panel displays have been developed. Examples include liquid crystal displays, field emission displays, plasma display panels, and organic light-emitting diode (OLED) displays. OLED displays have a wide viewing angle, rapid response speed, are thin, and have low power consumption. An OLED display may have a DC-DC converter that converts external power into internal power for driving the pixels of the display and a display panel driver.

SUMMARY

In accordance with one or more embodiments, a display device includes a display panel including a plurality of pixels to be driven based on a first power voltage and a second power voltage; a display panel driver to divide one frame into a first pulse period, a second pulse period, and a third pulse period, and to output a control signal to generate an analog supply voltage, the first power voltage, and the second power voltage, the display panel driver to be driven based on the analog supply voltage; and a DC-DC converter electrically coupled to the display panel driver, the DC-DC converter to receive the control signal from the display panel driver through a single wire. The DC-DC converter includes an analog supply voltage generator to generate the analog supply voltage during the first pulse period, a first power voltage generator to generate the first power voltage during the second pulse period, and a second power voltage generator to generate the second power voltage during the third pulse period.

The control signal may be changed from an inactive state to an active state based on a start signal. The analog supply voltage generator may be enabled to generate the analog supply voltage having a predetermined voltage level when the control signal is changed from the inactive state to the active state.

The control signal may include a number of first pulses in the first pulse period, a number of second pulses in the second pulse period, a number of third pulses in the third pulse period, the numbers of pulses based on a power supply enable signal.

The first power voltage generator may be enabled to generate the first power voltage having a predetermined voltage level when the second pulse period starts. The second power voltage generator may be enabled to generate the second power voltage having a predetermined voltage level when the third pulse period starts. The analog supply voltage generator may control a voltage level of the analog supply voltage based on the number of first pulses input during the first pulse period.

The first power voltage generator may control a voltage level of the first power voltage based on the number of second pulses input during the second pulse period. The second power voltage generator may control a voltage level of the second power voltage based on the number of third pulses input during the third pulse period.

The analog supply voltage generator may be disabled when the number of a first pulses input during the first pulse period is equal to a predetermined number. The first power voltage generator may be disabled when the number of second pulses input during the second pulse period is equal to a predetermined number. The second power voltage generator may be disabled when a number of third pulses input during the third pulse period is equal to a predetermined number. The first power voltage generator and the second power voltage generator may be disabled when the control signal is changed from an active state to an inactive state.

In accordance with one or more other embodiments, an electronic device includes a display device and a processor to control the display device, the display device including: a display panel including a plurality of pixels to be driven based on a first power voltage and a second power voltage; a display panel driver to divide one frame into a first pulse period, a second pulse period, and a third pulse period, and to output a control signal to generate an analog supply voltage, the first power voltage, and the second power voltage, the display panel driver to be driven based on the analog supply voltage; and a DC-DC converter electrically coupled to the display panel driver, the DC-DC converter to receive the control signal from the display panel driver through a single wire. The DC-DC converter includes an analog supply voltage generator to generate the analog supply voltage in the first pulse period, a first power voltage generator to generate the first power voltage in the second pulse period, and a second power voltage generator to generate the second power voltage in the third pulse period.

The control signal may be changed from an inactive state to an active state based on a start signal provided from a timing controller, and the analog supply voltage generator may be enabled to generate the analog supply voltage having a predetermined voltage level when the control signal is changed from the inactive to the active state.

The control signal may include a number of first pulses during the first pulse period, a number of second pulses during the second pulse period, a number of third pulses during the third pulse period, and the numbers of first, second, and third pulses are based on a power supply enable signal.

The first power voltage generator may be enabled to generate the first power voltage having a predetermined voltage level when the second pulse period starts, and the second power voltage generator may be enabled to generate the second power voltage having a predetermined voltage level when the third pulse period starts.

The analog supply voltage generator may control a voltage level of the analog supply voltage based on the number of first pulses input during the first pulse period, the first power voltage generator may control a voltage level of the first power voltage based on the number of second pulses input during the second pulse period, and the second power voltage generator may control a voltage level of the second power voltage based on the number of third pulses input during the third pulse period.

The analog supply voltage generator may be disabled when the number of first pulses input during the first pulse period is equal to a predetermined number, the first power voltage generator may be disabled when the number of second pulses input during the second pulse period is equal to a predetermined number, and the second power voltage generator may be disabled when the number of third pulses input during the third pulse period is equal to a predetermined number. The analog supply voltage generator may be disabled when the number of first pulses input during the first pulse period is equal to a predetermined number, and the first power voltage generator and the second power voltage generator may be disabled when the control signal is changed from an inactive state to an active state.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
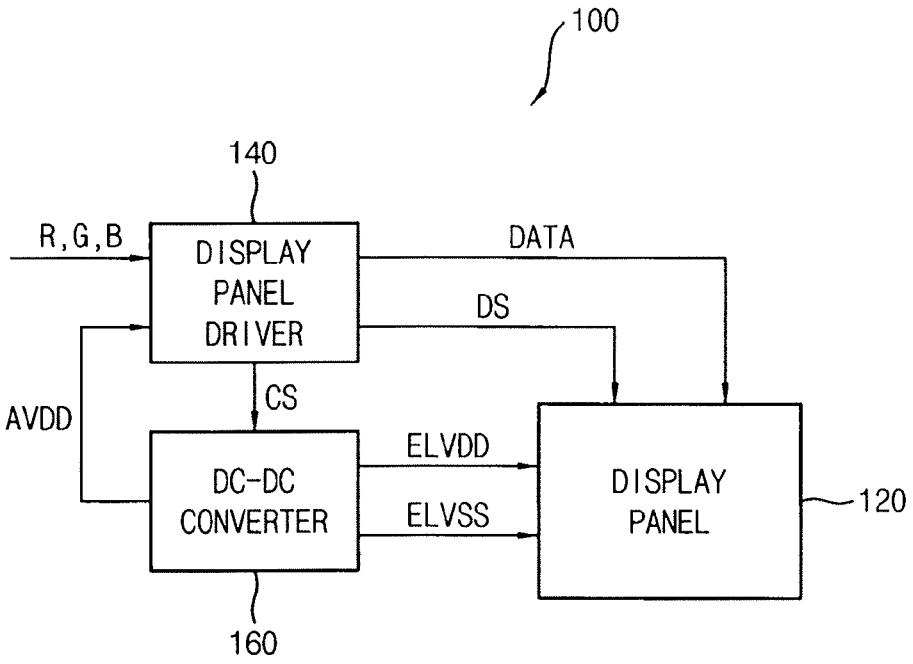
FIG. 1 illustrates an embodiment of a display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawings, the dimensions of layers and regions may be exaggerated for clarity of illustration. Like reference numerals refer to like elements throughout.

Figure 2:
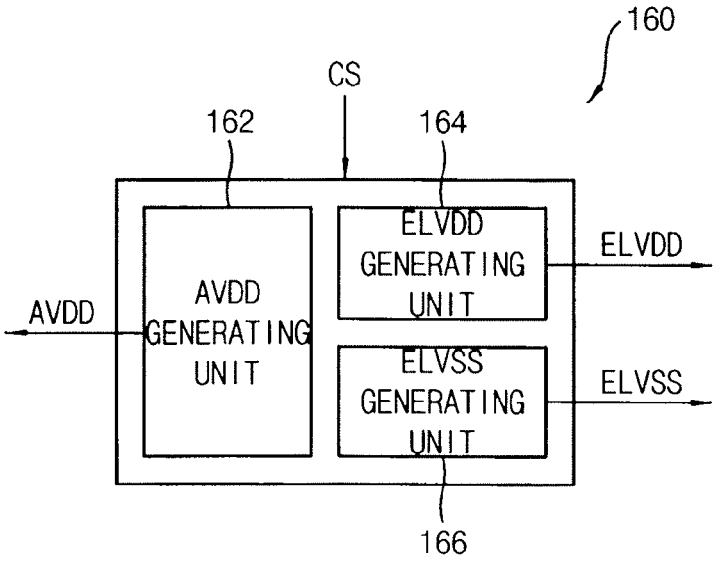
FIG. 2 illustrates an embodiment of a DC-DC converter.

FIG. 1 illustrates an embodiment of a display device 100, and FIG. 2 illustrates an embodiment of a DC-DC converter, which, for example, may be in the display device of FIG. 1.

Referring to FIGS. 1 and 2, the display device 100 includes a display panel 120, a display panel driver 140, and a DC-DC converter 160. The display panel 120 includes a plurality of pixels at intersections of a plurality of data lines and a plurality of scan lines. Each pixel may be driven based on a first power voltage ELVDD and a second power voltage ELVSS. Also, each pixel may include an organic light emitting diode, which emits light when holes from an anode (to which the first power voltage ELVDD is applied) and electrons (from a cathode to which the second power voltage ELVSS is applied) are combined in an organic light emitting layer. The pixels may operate based on a data signal DATA and a pixel driving signal DS from the display panel driver 140. The pixel driving signal DS may include, for example, a scan signal, an emitting control signal, and/or other control signals generated based on the data signal DATA.

The display panel driver 140 operates based on a plurality of periods in one frame. The periods may include, for example, a first pulse period, a second pulse period, and a third pulse period. The display panel driver 140 outputs a control signal CS for generating an analog supply voltage AVDD, the first power voltage ELVDD, and the second power voltage ELVSS. The display panel driver 140 may be driven based on the analog supply voltage AVDD. The display driving circuit 140 may generate the data signal DATA and the pixel driving signal DS based on image data (e.g., R, G, B) provided, for example, from an external source. The display panel driver 140 converts the image data R, G, B, provided in a digital signal, to the data signal DATA having an analog voltage for input into corresponding ones of the pixels.

The display panel driver 140 may output the control signal CS for generating the analog supply voltage AVDD, the first power voltage ELVDD, and the second power voltage ELVSS. The display panel driver 140 may generate the control signal CS based on signals provided, for example, from a timing controller. In one embodiment, the display panel driver 140 changes the control signal CS from an inactive state to an active state based on a start signal from the timing controller.

Further, the display panel driver 140 may divide one frame into (e.g., provide signals are pulses in) the first pulse period, the second pulse period, and the third pulse period based on a power enable signal from the timing controller. The control signal CS may have (or, may output) a number of first pulses during the first pulse period, a number of second pulses during the second pulse period, and a number of third pulses during the third pulse period, where the number of pulses may be 0 or more in each period. In one embodiment, the timing controller may be included in the display panel driver 140. In another embodiment, the timing controller may be coupled to the display panel driver 140.

The DC-DC converter 160 is electrically coupled to the display panel driver 140. The DC-DC converter 160 may receive the control signal CS from the display panel driver 140 through a single wire (S-WIRE). The DC-DC converter 160 may include an analog supply voltage generating unit 162, a first power voltage generating unit 164, and a second power voltage generating unit 166. Each of the analog supply voltage generating unit 162, the first power voltage generating unit 164, and the second power voltage generating unit 166 may be enabled or disabled based on the control signal CS provided through the single wire.

The DC-DC converter 160 may be enabled when the control signal CS changes from the inactive state to the active state. The analog supply voltage generating unit 162, that is included in the DC-DC converter 160, may be enabled to generate the analog voltage AVDD having a predetermined voltage level when the control signal CS changes from the inactive state to the active state. The control signal CS may be provided from the display panel driver 140 to the DC-DC converter 160 based on the power supply unit enable signal. The analog supply voltage generating unit 162 may control a voltage level of the analog supply voltage AVDD based on the number of first pulses input during the first pulse period.

In one example embodiment, the analog supply voltage generating unit 162 increases the voltage level of the analog supply voltage AVDD as the number of first pulses increases. In another example embodiment, the analog supply voltage generating unit 162 may decrease the voltage level of the analog supply voltage AVDD as the number of first pulses increases. In another example embodiment, the analog supply voltage generating unit 162 may determine the voltage level of the analog supply voltage AVDD using a look up table (LUT), that stores voltage levels of the analog supply voltage AVDD corresponding to the number of first pulses.

The first power voltage generating unit 164 may be enabled when the second pulse period starts. The first power voltage generating unit 164 may generate the first power voltage ELVDD having a predetermined voltage level. The first power voltage generating unit 164 may control the voltage level of the first power voltage ELVDD based on the number of second pulses input during the second pulse period.

In one example embodiment, the first power voltage generating unit 164 increases the voltage level of the first power voltage ELVDD as the number of second pulses increases. In another example embodiment, the first power voltage generating unit 164 decreases the voltage level of the first power voltage ELVDD as the number of second pulses increases. In other example embodiments, the first power voltage generating unit 164 may determine the voltage level of the first power voltage ELVDD using a look up table, that stores voltage levels of the first power voltage ELVDD corresponding to the number of second pulses.

The second power voltage generating unit 166 may be enabled at a predetermined time, e.g., when the third pulse period starts. The second power voltage generating unit 166 may be enabled at a predetermined time, e.g., when the third pulse period starts. The second power voltage generating unit 166 may generate the second power voltage ELVSS having a predetermined voltage level.

The second power voltage generating unit 166 may control the voltage level of the second power voltage ELVSS based on the number of third pulses input during the third pulse period. In one example embodiment, the second power voltage generating unit 166 may increase the voltage level of the second power voltage ELVSS as the number of third pulses increases. In another example embodiment, the second power voltage generating unit 166 may decrease the voltage level of the second power voltage ELVSS as the number of third pulse increases. In another example embodiment, the second power voltage generating unit 166 may determine the voltage level of the second power voltage ELVSS using a look up table, that stores voltage levels of the second power voltage ELVSS corresponding to the number of third pulses.

The analog supply voltage AVDD generated in the DC-DC converter 160 may be provided to the display panel driver 140. The first power voltage ELVDD and the second power voltage ELVSS generated in the DC-DC converter 160 may be provided to the display panel 120. As described, the DC-DC converter 160 may generate the analog supply voltage AVDD, the first power voltage ELVDD, and the second power voltage ELVSS based on the control signal CS that has the first pulse, the second pulse, and the third pulse.

The analog supply voltage generating unit 162 may be disabled at a predetermined time, e.g., when the number of first pulses input during the first pulse period is equal to a predetermined number. In one example embodiment, the first power voltage generating unit 164 may be disabled at a predetermined time, e.g., when the number of the second pulse input during the second pulse period is equal to a predetermined number. The second power voltage generating unit 166 may be disabled at a predetermined time, e.g., when the number of the third pulse input during the third pulse period is equal to a predetermined number. In another example embodiment, the first power voltage generating unit 164 and the second power voltage generating unit 166 may be disabled at same or different times, e.g., when the control signal CS is changed from the active state to the inactive state.

In accordance with the present embodiment, the display device 100 generates the analog supply voltage AVDD, the first power voltage ELVDD, and the second power voltage ELVSS based on the control signal CS from the display panel driver 140 through the single wire. The control signal CS, that has the first pulse, the second pulse, and the third pulse, may be time-divisionally provided. Thus, the number of connecting lines that couple the display panel driver 140 and the DC-DC converter 160 may be reduced.

Figure 3:
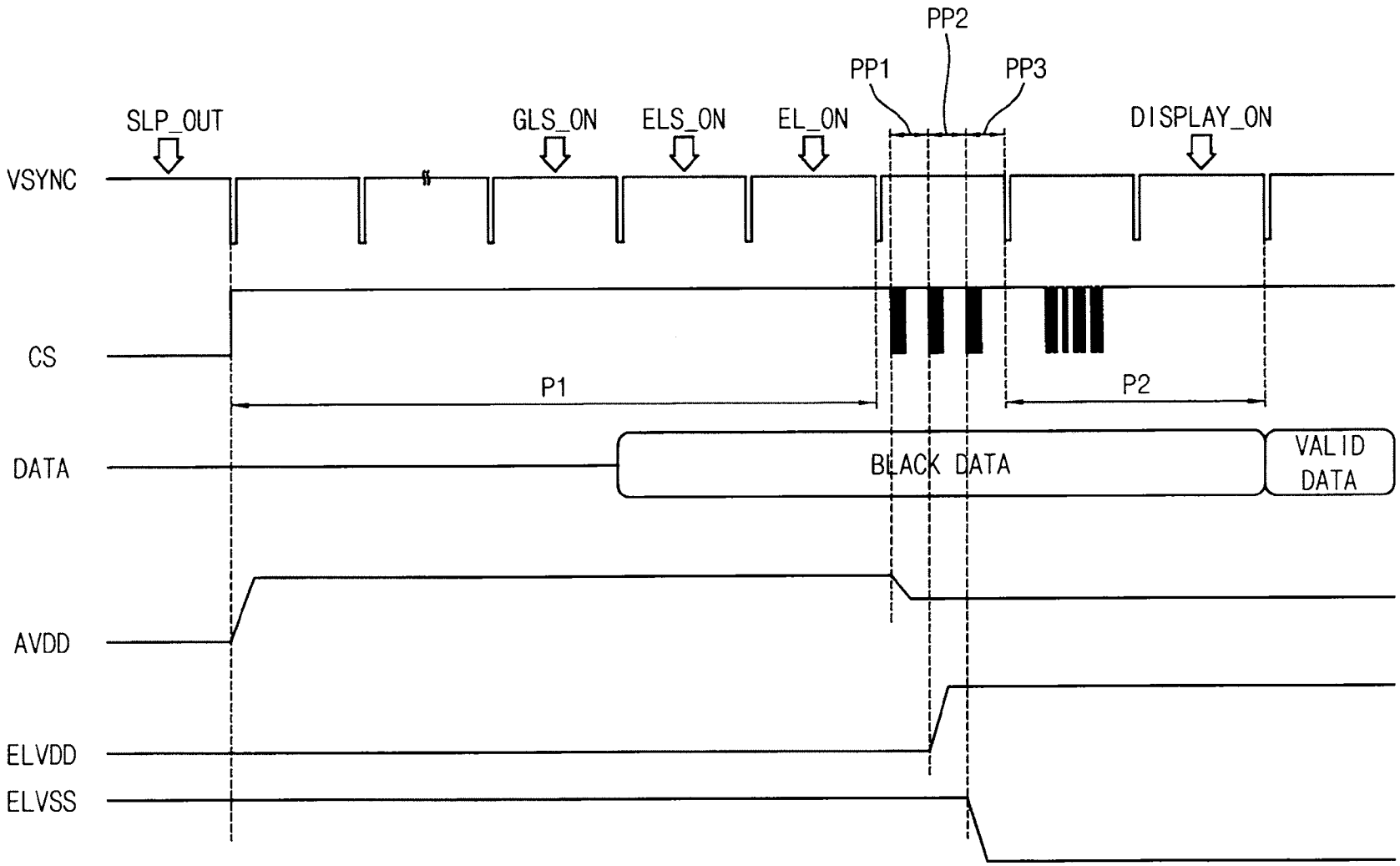
FIG. 3 illustrates an example of control signals for the DC-DC converter.
Figure 4:
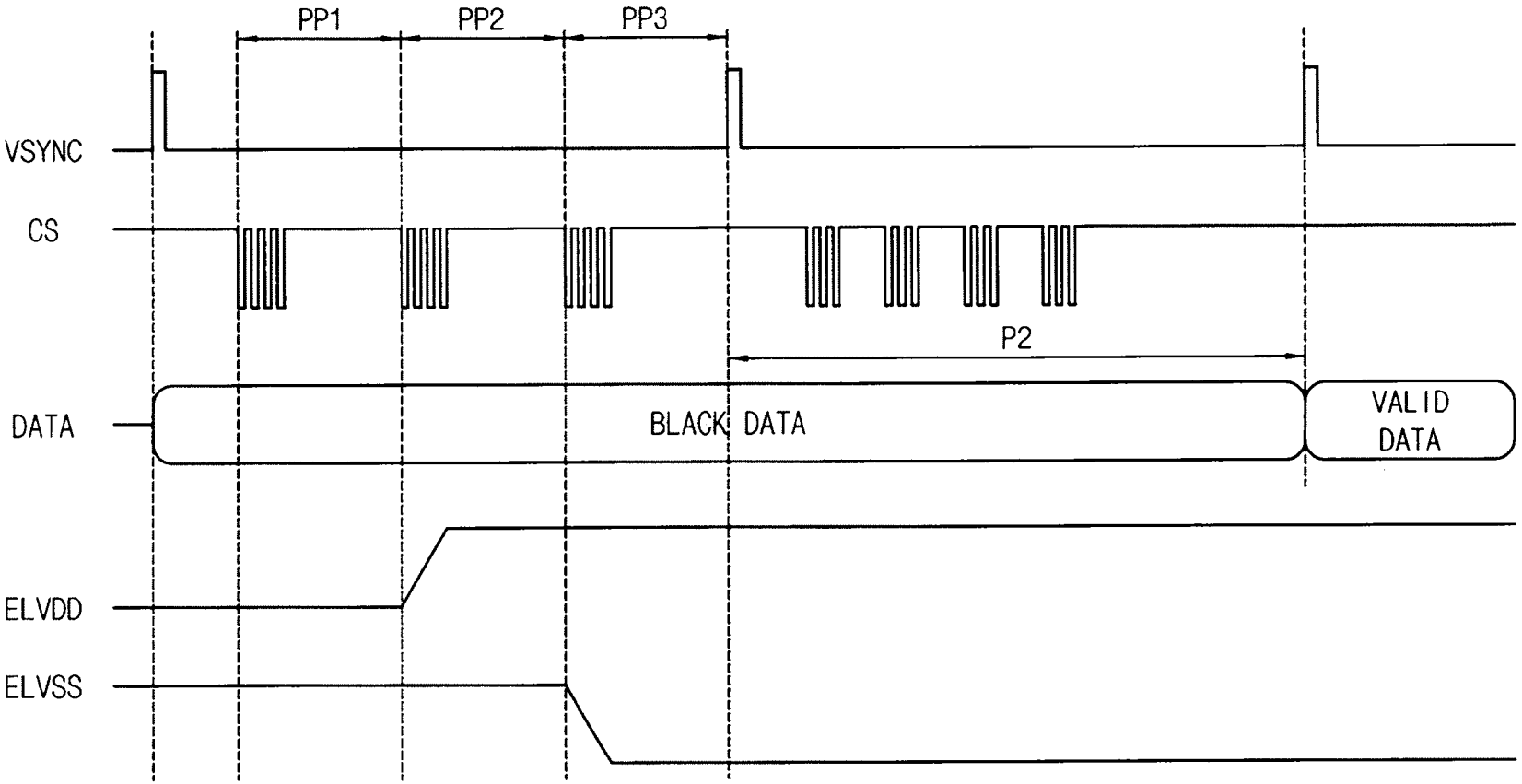
FIG. 4 illustrates an enlarged portion of the control signals in FIG. 3.

FIG. 3 is a timing diagram illustrating an example of control signals for an enable operation of the DC-DC converter 160, and FIG. 4 illustrates an enlarged portion of the timing diagram in FIG. 3.

Referring to FIG. 3, the control signal CS may be generated in the display panel driver 140 based on signals from the timing controller. The display panel driver 140 may provide the control signal CS to the DC-DC converter 160. The control signal CS may be changed from the inactive state to the active state based on a start signal SLP_OUT from the timing controller. The control signal CS may be activated in synchronized with a predetermined edge (e.g., rising edge, falling edge, etc.) of a vertical synchronization signal VSYNC when the start signal SLP_OUT is input to the display panel driver 140. The DC-DC converter 160 may be enabled when the control signal CS that is activated is input. The analog supply voltage generating unit 162, that is included in the DC-DC converter 160, may be enabled to generate the analog supply voltage AVDD having the predetermined voltage level when the control signal CS that is activated is input.

The display panel driver 140 may time-divisionally provide the control signal CS to the DC-DC converter 160. The display panel driver 140 may divide one frame into the first pulse period PP1, the second pulse period PP2, and the third pulse period PP3 based on the power supply enable signal EL_ON from the timing controller. The display panel driver 140 may output signals such as a scan signal and an emission control signal The scan signal drives the scan driver based on a scan driver enable signal GLS_ON from the timing controller. The emission control signal controls the emission control driver based on an emission control driver enable signal ELS_IN from the timing controller during a first period P1.

The control signal CS may have the first pulse during the first pulse period PP1, the second pulse during the second pulse period PP2, and the third pulse during the third pulse period PP3. The DC-DC converter 160 may determine that the first pulse period PP1 is finished based on a predetermined condition, e.g., when the width of the first pulse is wider than a predetermined width or when the first pulse is not input within a predetermined time. The DC-DC converter 160 may determine that the second pulse period PP2 is finished based on a predetermined condition, e.g., when the width of the second pulse is wider than a predetermined width or when the second pulse is not input within a predetermined time. The DC-DC converter 160 may determine that the third pulse period PP3 is finished based on a predetermined condition, e.g., when the width of the third pulse is wider than a predetermined width or when the third pulse is not input in a predetermined time.

The analog supply voltage generating unit 162 may control the voltage level of the analog supply voltage AVDD based on the number of first pulses input during the first pulse period PP 1. For example, the analog supply voltage generating unit 162 may maintain the voltage level of the analog supply voltage AVDD when the number of first pulses is zero and may increase the voltage level of the analog supply voltage AVDD as the number of first pulses increases.

The first power voltage generating unit 164 may be enabled to generate the first power voltage having a predetermined voltage level when the second pulse period PP2 starts. The first power voltage generating unit 164 may control the voltage level of the first power voltage ELVDD based on the number of second pulses input during the second pulse period PP2. For example, the first power voltage ELVDD may maintain the voltage level of the first power voltage ELVDD when the number of second pulses is zero and may increase the voltage level of the first power voltage ELVDD as the number of second pulses increases.

The second power voltage generating unit 166 may be enabled to generate the second power voltage having a predetermined voltage level when the third pulse period PP3 starts. Further, the second power voltage generating unit 166 may control the voltage level of the second power voltage ELVSS based on the number of third pulses input during the third pulse period PP3. For example, the second power voltage ELVSS may maintain the voltage level of the second power voltage ELVSS when the number of third pulses is zero and may increase the voltage level of the second power voltage ELVSS as the number of third pulses increases.

The display panel driver 140 may provide the data signal DATA, into which the image data R, G, B is converted to the display panel 120, based on a display enable signal DISPLAY_ON. Additional pulses that control additional functions of the DC-DC converter 160 may be input during a second period P2. For example, the DC-DC converter 160 may control a driving frequency based on the additional pulses.

In one embodiment, the voltage levels of the analog supply voltage AVDD, the first power voltage ELVDD, and the second power voltage ELVSS may be maintained at the predetermined voltage levels. However, the voltage levels of the analog supply voltage AVDD, the first power voltage ELVDD, and the second power voltage ELVSS may be changed when an operating mode of the display panel 120 is changed.

For example, when the operation mode of the display panel 120 is changed to a power saving mode for saving a power consumption, the display panel driver 140 may generate the control signal CS to change the voltage level of the second power voltage ELVSS. The DC-DC converter 160 may change the voltage level of the second power voltage ELVSS based on the control signal CS input during the third pulse period PP3.

Further, when the display panel 120 operates in a blockwise driving method, the display panel driver 140 may generate the control signal CS to change the voltage level of the first power voltage ELVDD. The DC-DC converter 160 may change the first power voltage ELVDD based on the control signal CS input during the second pulse period PP2.

An enable timing of the analog supply voltage generating unit 162, the first power voltage generating unit 164, and the second power generating unit 166 may be changed based on the kind of DC-DC converter 160 and its driving method. Examples of the analog supply voltage generating unit 162, the first power voltage generating unit 164, and the second power generating unit 166, that are sequentially enabled, are described in FIGS. 3 and 4.

As described above, the display device 100 may include the display panel 120, the display panel driver 140, and the DC-DC converter 160. The display panel driver 140 may generate the control signal CS that is time-divisionally provided to the DC-DC converter 160 through the single wire. The DC-DC converter 160 may generate the analog supply voltage AVDD, the first power voltage ELVDD, and the second power voltage ELVSS based on the control signal CS that is time-divisionally provided. Thus, the number of connecting lines that couples the display panel driver 140 and the DC-DC converter 160 may be reduced.

Figure 5:
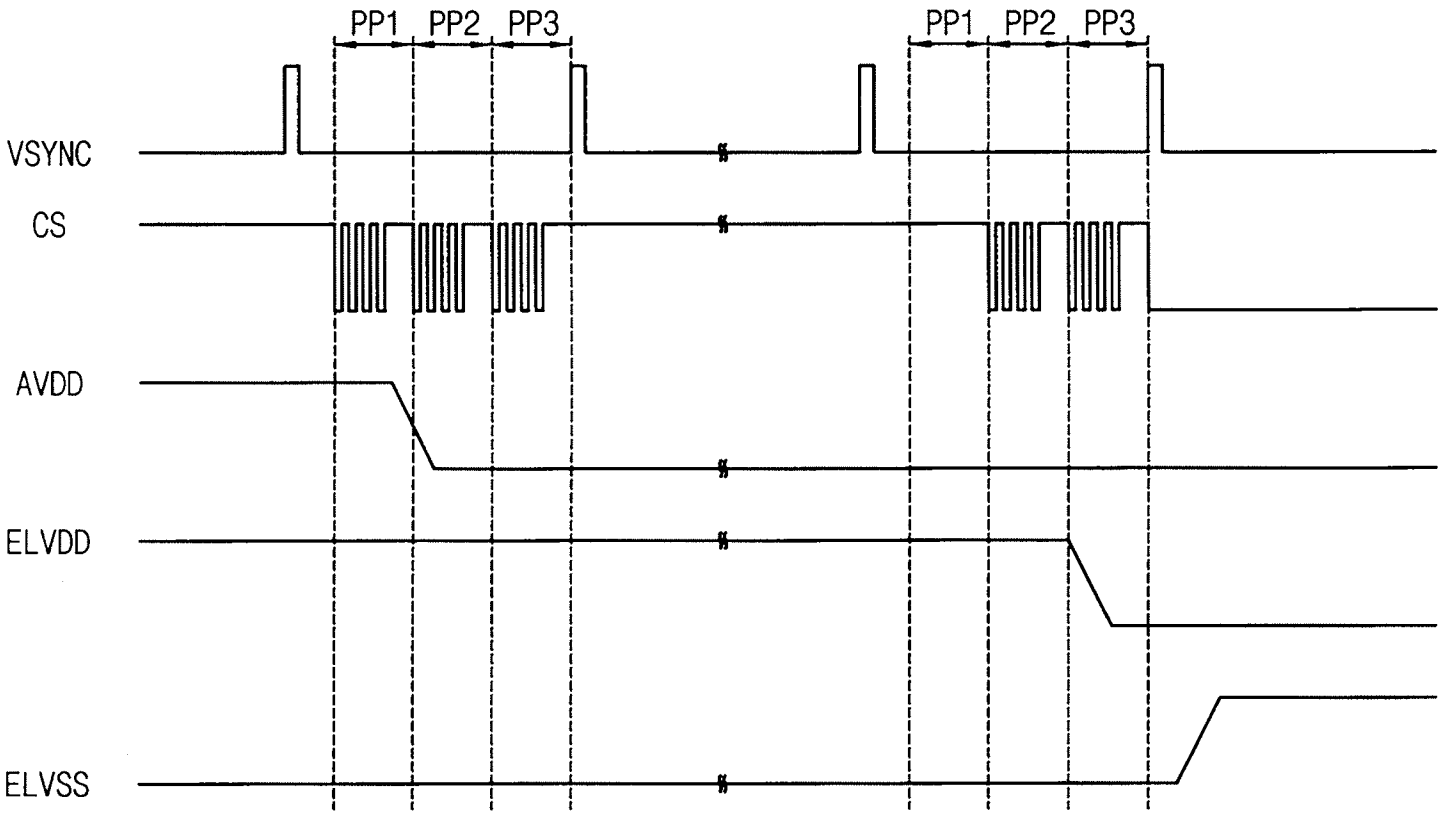
FIG. 5 illustrates another example of control signals for the DC-DC converter.

FIG. 5 is a timing diagram illustrating an example of control signals for performing a disable operation of the DC-DC converter 160 in FIG. 1. Referring to FIG. 5, the analog supply voltage generating unit 162, the first power voltage generating unit 164, and the second power voltage generating unit 166 may be sequentially disabled at one or more predetermined timings. The analog supply voltage generating unit 162 may be disabled, for example, when the number of first pulses input during the first pulse period PP1 is equal to a predetermined number.

In one embodiment, the analog supply voltage generating unit 162 is disabled when four first pulses are input during the first pulse period PP 1. The first power voltage generating unit 164 may be disabled when the number of second pulses input during the second pulse period PP2 is equal to a predetermined number. For example, the first power voltage generating unit 164 may be disabled when four second pulses are input during the second pulse period PP2. The second power voltage generating unit 166 may be disabled, for example, when the number of third pulses input during the third pulse period PP3 is equal to a predetermined number. For example, the second power voltage generating unit 166 may be disabled when four third pulses are input during the third pulse period PP3.

The disable timing of the analog supply voltage generating unit 162, the first power voltage generating unit 164, and the second power generating unit 166 may be changed based on the kind of DC-DC converter 160 and its driving method. Non-limiting examples of the operation of the analog supply voltage generating unit 162, the first power voltage generating unit 164, and the second power generating unit 166, that are sequentially disabled, are described in FIG. 5.

Figure 6:
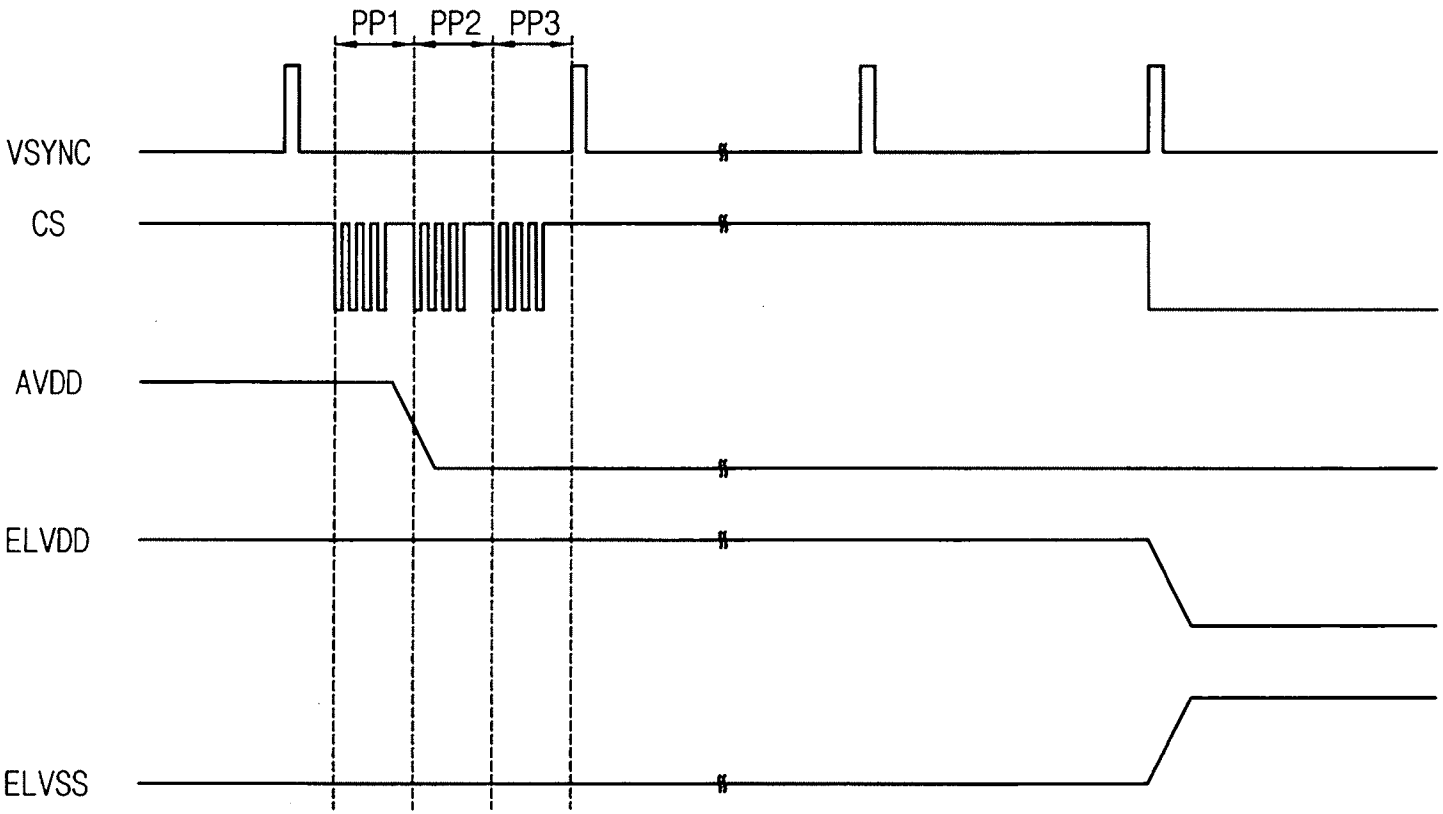
FIG. 6 illustrates another example of control signals for the DC-DC converter.

FIG. 6 is a timing diagram illustrating another example of control signals for performing a disable operation of the DC-DC converter 160 in FIG. 1. Referring to FIG. 6, the first power voltage generating unit 164 and the second power voltage generating unit 166 may be disabled, for example, when the control signal CS is changed from the active state to the inactive state. The analog supply voltage generating unit 162 may be disabled, for example, when the number of first pulses input during the first pulse period PP1 is equal to the predetermined number. For example, the analog supply voltage generating unit 162 may be disabled when four first pulses are input during the first pulse period PP 1. The first power voltage generating unit 164 and the second power voltage generating unit 166 may be disabled, for example, when the control signal CS is changed from the active state to the inactive state in synchronized with the vertical synchronizing signal VSYNC.

The disable timing of the analog supply voltage generating unit 162, the first power voltage generating unit 164, and the second power generating unit 166 may be changed based on the kind of DC-DC converter 160 and its driving method. Non-limiting examples of the operation of the first power voltage generating unit 164 and the second power generating unit 166, that are disabled after the analog supply voltage generating unit 162 is disabled, are described in FIG. 6.

Figure 7:
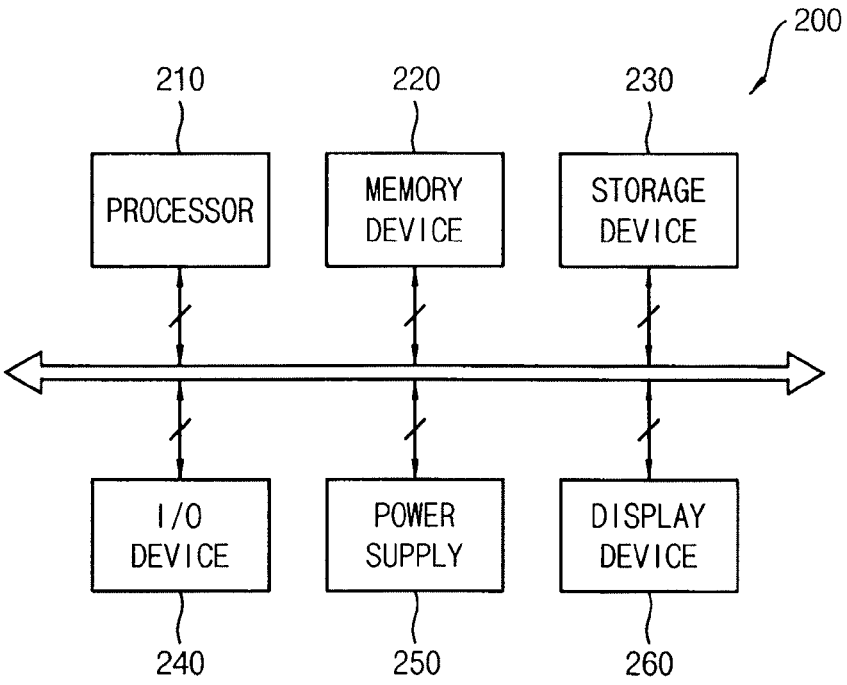
FIG. 7 illustrates an embodiment of an electronic device.
Figure 8:
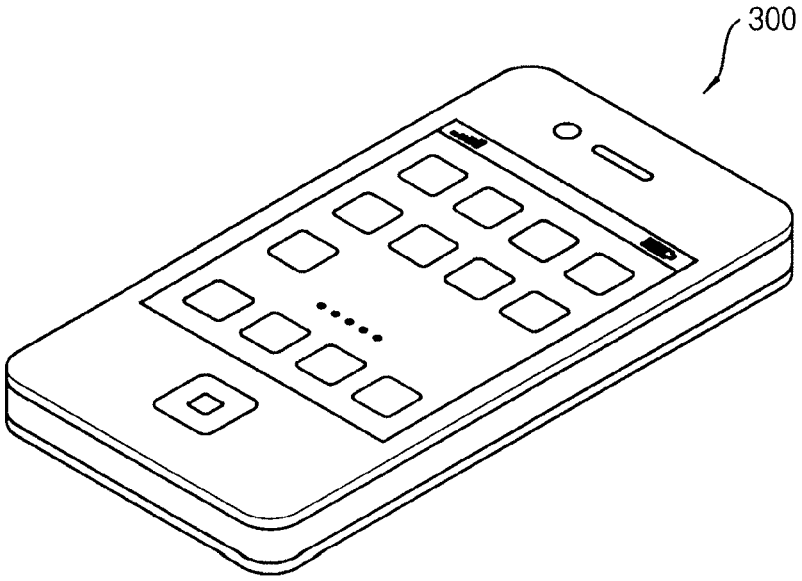
FIG. 8 illustrates an embodiment of a smart phone.

FIG. 7 illustrates an embodiment of an electronic device 200, and FIG. 8 illustrating an embodiment where the electronic device in FIG. 7 is a smart phone. Referring to FIGS. 7 and 8, the electronic device 200 includes a processor 210, a memory device 220, a storage device 230, an input/output (I/O) device 240, a power supply 250, and a display device 260. The display device 260 may correspond to the display device 100 of FIG. 1.

The electronic device 300 may further include a plurality of ports for communicating a video card, a sound card, a memory card, a universal serial bus (USB) device, other electronic device, etc. Although FIG. 8 illustrates the electronic device 200 as a smart-phone 300, the electronic device 200 may be another type of device or system (e.g., media player, navigation system, tablet, or another device having or coupled to a display) in another embodiment.

The processor 210 may perform various computing functions. The processor 210 may be a micro processor, a central processing unit (CPU), etc. The processor 210 may be coupled to other components via an address bus, a control bus, a data bus, etc. Further, the processor 210 may be coupled to an extended bus such as peripheral component interconnect (PCI) bus.

The memory device 220 may store data for operations of the electronic device 200. For example, the memory device 220 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 230 may be a solid state drive (SSD) device, a hard disk drive (HDD) device, a CD-ROM device, etc.

The I/O device 240 may be an input device such as a keyboard, a keypad, a touchpad, a touch-screen, a mouse, etc., and an output device such as a printer, a speaker, etc. In one embodiment, the display device 260 may be in the I/O device 240. The power supply 250 may provide a power for operations of the electronic device 200. The display device 260 may communicate with other components via the buses or other communication links.

The display device 260 may include a display panel, a display panel driver, and a DC-DC converter. The display panel includes a plurality of pixels that operate based on a data signal and a pixel driving signal from the display panel driver. The display panel driver may be operated based on an analog supply voltage. The display panel driver may output the control signal for generating the analog supply voltage, a first power voltage, and a second power voltage.

For example, the display panel driver may change the control signal from an inactive state to an active state based on a start signal from a timing controller. Further, the display panel driver may divide one frame into a first pulse period, a second pulse period, and a third pulse period based on a power enable signal from the timing controller. The control signal CS may have a number of first pulses during the first pulse period, a number of second pulses during the second pulse period, and a number of third pulses during the third pulse period, where the numbers of pulses in each period may be 0 or more.

The DC-DC converter may be electrically coupled to the display panel driver. The DC-DC converter may receive the control signal through a single wire S-WIRE.

The DC-DC converter may include the analog supply voltage generating unit, the first power voltage generating unit, and the second power voltage generating unit as previously discussed. The analog supply voltage generating unit, the first power voltage generating unit, and the second power voltage generating unit may be enabled or disabled based on the control signal.

The DC-DC converter may be enabled when the control signal is changed from the inactive state to the active state. The analog supply voltage generating unit may be enabled to generate the analog supply voltage having a predetermined voltage level when the control signal is changed from the inactive state to the active state. The control signal may be provided from the display panel driver to the DC-DC converter based on the power supply unit enable signal.

The analog supply voltage generating unit may control the voltage level of the analog supply voltage based on a number of first pulses input during the first pulse period. The first power voltage generating unit may be enabled when the second pulse period starts. The first power voltage generating unit may generate the first power voltage having a predetermined voltage level. The first power voltage generating unit may control the voltage level of the first power voltage based on the number of second pulses input during the second pulse period.

The second power voltage generating unit may be enabled when the third pulse period starts. The second power voltage generating unit may generate the second power voltage having a predetermined voltage level. The second power voltage generating unit may control the voltage level of the second power voltage based on the number of third pulses input during the third period.

As described, the DC-DC converter may generate the analog supply voltage, the first power voltage, and the second power voltage based on the control signal that is time-divisionally provided through single wire.

The analog supply voltage generating unit may be disabled when the number of the first pulse that is input during the first pulse period is equal to a predetermined number. In one example embodiment, the first power voltage generating unit may be disabled when the number of second pulses output during the second pulse period is equal to a predetermined number. The second power voltage generating unit may be disabled when the number of third pulses output during the third pulse period is equal to a predetermined number. In another example embodiment, the first power voltage generating unit and the second power voltage generating unit may be disabled when the control signal is changed from the active state to the inactive state.

As described above, the display panel 260 of the electronic device 200 may generate the analog supply voltage, the first power voltage, and the second power voltage based on the control signal from the display panel driver provided through the single wire. The control signal may have first pulses, second pulses, and third pulses that are time-divisionally provided. Thus, the number of connecting lines coupling the display panel driver and the DC-DC converter may be reduced.

The aforementioned embodiments may be applied to a display device and an electronic device having the display device. For example, the aforementioned embodiments may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

By way of summation and review, a display driver has been proposed which provides signals to generate analog supply and power voltages to a DC/DC converter through a plurality of two lines. In accordance with one or more of the aforementioned embodiments, a display driver (e.g., display panel driver integrated circuit) provides a control signal to generate analog supply and power voltages signals to a DC/DC converter all through one line. The driver may time-divisionally provide the control signal through the wire. Thus, the number of lines for coupling the driver and DC/DC may be significantly reduced.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display device, comprising:

a display panel including a plurality of pixels to be driven based on a first power voltage and a second power voltage;

a display panel driver to divide one frame into a first pulse period, a second pulse period, and a third pulse period, and to output a control signal to generate an analog supply voltage, the first power voltage, and the second power voltage, the display panel driver to be driven based on the analog supply voltage; and a DC-DC converter electrically coupled to the display panel driver, the DC-DC converter to receive the control signal from the display panel driver through a single wire, wherein the DC-DC converter includes:

an analog supply voltage generator to generate the analog supply voltage during the first pulse period, a first power voltage generator to generate the first power voltage during the second pulse period, and a second power voltage generator to generate the second power voltage during the third pulse period.

2. The display device as claimed in claim 1, wherein the control signal is to be changed from an inactive state to an active state based on a start signal.

3. The display device as claimed in claim 2, wherein the analog supply voltage generator is to be enabled to generate the analog supply voltage having a predetermined voltage level when the control signal is changed from the inactive state to the active state.

4. The display device as claimed in claim 3, wherein the control signal has:

a number of first pulses during the first pulse period, a number of second pulses during the second pulse period, a number of third pulses during the third pulse period, and the numbers of first, second, and third pulses are based on a power supply enable signal.

5. The display device as claimed in claim 4, wherein the first power voltage generator is to be enabled to generate the first power voltage having a predetermined voltage level when the second pulse period starts.

6. The display device as claimed in claim 4, wherein the second power voltage generator is to be enabled to generate the second power voltage having a predetermined voltage level when the third pulse period starts.

7. The display device as claimed in claim 4, wherein the analog supply voltage generator is to control a voltage level of the analog supply voltage based on the number of first pulses input during the first pulse period.

8. The display device as claimed in claim 4, wherein the first power voltage generator is to control a voltage level of the first power voltage based on the number of second pulses input during the second pulse period.

9. The display device as claimed in claim 4, wherein the second power voltage generator is to control a voltage level of the second power voltage based on the number of third pulses input during the third pulse period.

10. The display device as claimed in claim 4, wherein the analog supply voltage generator is to be disabled when the number of a first pulses input during the first pulse period is equal to a predetermined number.

11. The display device as claimed in claim 5, wherein the first power voltage generator is to be disabled when the number of second pulses input during the second pulse period is equal to a predetermined number.

12. The display device as claimed in claim 4, wherein the second power voltage generator is to be disabled when a number of third pulses input during the third pulse period is equal to a predetermined number.

13. The display device as claimed in claim 6, wherein the first power voltage generator and the second power voltage generator are to be disabled when the control signal is changed from an active state to an inactive state.

14. An electronic device, comprising:

a display device; and a processor to control the display device, the display device including:

a display panel including a plurality of pixels to be driven based on a first power voltage and a second power voltage;

a display panel driver to divide one frame into a first pulse period, a second pulse period, and a third pulse period, and to output a control signal to generate an analog supply voltage, the first power voltage, and the second power voltage, the display panel driver to be driven based on the analog supply voltage; and a DC-DC converter electrically coupled to the display panel driver, the DC-DC converter to receive the control signal from the display panel driver through a single wire, wherein the DC-DC converter includes:

an analog supply voltage generator to generate the analog supply voltage during the first pulse period, a first power voltage generator to generate the first power voltage during the second pulse period, and a second power voltage generator to generate the second power voltage during the third pulse period.

15. The electronic device as claimed in claim 14, wherein:

the control signal is to be changed from an inactive state to an active state based on a start signal, and the analog supply voltage generator is to be enabled to generate the analog supply voltage having a predetermined voltage level when the control signal is changed from the inactive state to the active state.

16. The electronic device as claimed in claim 15, wherein the control signal has:

a number of first pulses during the first pulse period, a number of second pulses during the second pulse period, a number of third pulses during the third pulse period, and the numbers of first, second, and third pulses are based on a power supply enable signal.

17. The electronic device as claimed in claim 16, wherein: the first power voltage generator is to be enabled to generate the first power voltage having a predetermined voltage level when the second pulse period starts, and the second power voltage generator is to be enabled to generate the second power voltage having a predetermined voltage level when the third pulse period starts.

18. The electronic device as claimed in claim 16, wherein: the analog supply voltage generator is to control a voltage level of the analog supply voltage based on the number of first pulses input during the first pulse period, the first power voltage generator is to control a voltage level of the first power voltage based on the number of second pulses input during the second pulse period, and the second power voltage generator is to control a voltage level of the second power voltage based on the number of third pulses input during the third pulse period.

19. The electronic device as claimed in claim 16, wherein:

the analog supply voltage generator is to be disabled when the number of first pulses input during the first pulse period is equal to a predetermined number, the first power voltage generator is to be disabled when the number of second pulses input during the second pulse period is equal to a predetermined number, and the second power voltage generator is to be disabled when the number of third pulses input during the third pulse period is equal to a predetermined number.

20. The electronic device as claimed in claim 16, wherein:

the analog supply voltage generator is to be disabled when the number of first pulses input during the first pulse period is equal to a predetermined number, and the first power voltage generator and the second power voltage generator are to be disabled when the control signal is changed from an inactive state to an active state.

* * * * *